US006230448B1

(12) United States Patent
Oliver et al.

(10) Patent No.: US 6,230,448 B1
(45) Date of Patent: May 15, 2001

(54) PUSH/PULL OUTRIGGER FOR MANUFACTURED HOME

(76) Inventors: James Oliver; Evon L. Oliver, both of P.O. Box 58, Hohenwald, TN (US) 38462

( * ) Notice: Subject to any disclaimer, the term of this patent is extended or adjusted under 35 U.S.C. 154(b) by 0 days.

(21) Appl. No.: 09/262,278

(22) Filed: Mar. 4, 1999

Related U.S. Application Data

(63) Continuation-in-part of application No. 09/186,102, filed on Nov. 5, 1998.

(51) Int. Cl.[7] ..... B66F 3/08; E02D 27/48; E04G 25/06

(52) U.S. Cl. ..... 52/126.7; 52/127.2; 52/143; 52/299; 52/693; 52/DIG. 11; 248/200.1; 248/354.3; 254/100

(58) Field of Search ..... 52/127.2, 126.6, 52/126.7, 143, 292, 299, 126.1, 126.5, 149, 291, 657, 693, 695, DIG. 11; 248/354.1, 354.3, 357, 200.1; 254/98, 100, 101, 133 A

(56) References Cited

U.S. PATENT DOCUMENTS

D. 340,790 * 10/1993 Goodrich et al. ..... D34/31
1,321,584 * 11/1919 Ash ..... 254/100 X
2,232,112 * 2/1941 Hubbell et al. ..... 254/100
2,519,364 * 8/1950 Fredholm ..... 248/354.3 X
3,208,725 * 9/1965 Fleming ..... 254/100
3,362,117 * 1/1968 Van Raden ..... 52/291 X
3,574,981 * 4/1971 Henschen ..... 52/127.2
3,606,231 * 9/1971 Kilborn ..... 248/354.3
4,304,078 * 12/1981 Meriwether, Jr. ..... 52/127.2
4,417,426 * 11/1983 Meng ..... 52/126.7
4,866,797 * 9/1989 Vollan ..... 52/126.6
4,937,989 * 7/1990 Miyares et al. ..... 52/126.7
5,105,598 * 4/1992 Wilcox ..... 52/693 X
5,271,596 * 12/1993 Holcomb ..... 249/24
5,359,821 * 11/1994 Merriman ..... 52/126.6 X
5,681,021 * 10/1997 Noll ..... 248/357

* cited by examiner

*Primary Examiner*—Laura A. Callo
(74) *Attorney, Agent, or Firm*—Calif Tervo

(57) ABSTRACT

An outrigger (10) for a manufactured home (90) spans between lower end (76) of main beam (70) and outer end (83) of a transverse floor joist (80) and selectively provides a push (raising force) or pull (lowering force) to joist outer end (83) to level floor (86). Outrigger (10) generally comprises and an elongate portion (20) of adjustable length for spanning between beam lower end (76) and joist outer end (83) for producing an outward force, and a bracket (50) attached to beam lower end (76) and a nut (65) fastening elongate portion (20) to bracket (50) for producing an inward force.

20 Claims, 1 Drawing Sheet

PUSH/PULL OUTRIGGER FOR MANUFACTURED HOME

CROSS REFERENCE TO RELATED APPLICATION

This application is a continuation-in-part of co-pending application Ser. No. 09/186,102 filed Nov. 5, 1998 now pending.

BACKGROUND OF THE INVENTION

1. Field of the Invention

This invention relates to structural support for the periphery of a manufactured home, mobile home or trailer coach, and more specifically to a slanted push/pull connector between a main beam and an outer end of a floor joist.

2. Description of the Related Art

A manufactured home typically includes one or more longitudinal main beams which support a plurality of transverse floor joists which directly support the floor and the wall structure including wall studs. The main beams are typically I-beams, but may be C-beams or have another configuration.

Often it is desirable to further support the outer ends of floor joists, for example to even the floor, to compensate for large local loads, or to compensate for adjacent large wall openings.

Occasionally the outer end of a joist is too high such that the floor is not level or the floor does not align across a mating seam.

Therefore, there has been a need for means both for supporting, i.e. pushing up, and for pulling down on the periphery of a manufactured home.

SUMMARY OF THE INVENTION

A push/pull outrigger for a manufactured home spans between the lower end of the main beam and the outer end of a transverse floor joist and selectively provides a push or pull force to the outer end of the floor joist to raise or lower the level of the floor. The outrigger generally comprises and an elongate portion of adjustable length for spanning between the lower end of the beam and the outer end of the joist, a bracket attached to the lower end of the beam, and a nut fastening the elongate portion to the bracket.

The elongate portion has a longitudinal axis and comprises a fixed portion and a movable portion. The fixed portion includes an upper end attached to the outer end of the joist such that the outrigger can exert an inward or outward longitudinal force on the joist and a lower end having a threaded bore. The movable portion is a threaded shaft having a lower end adapted for bearing against the beam and an upper end attached to the threaded bore of the fixed portion for adjusting the length of the elongate portion and exerting an outward force on joist outer end.

A bracket attached to the lower end of the beam includes a bore through which the lower end of the threaded shaft is freely disposed. A nut is attached to the threaded shaft between the bracket bore and the beam. Tightening the nut against the bracket while preventing the shaft from turning relative to the nut exerts an inward force on the joist outer end.

Other features and many attendant advantages of the invention will become more apparent upon a reading of the following detailed description together with the drawings in which like reference numerals refer to like parts throughout.

DETAILED DESCRIPTION OF THE INVENTION

Figure 1:
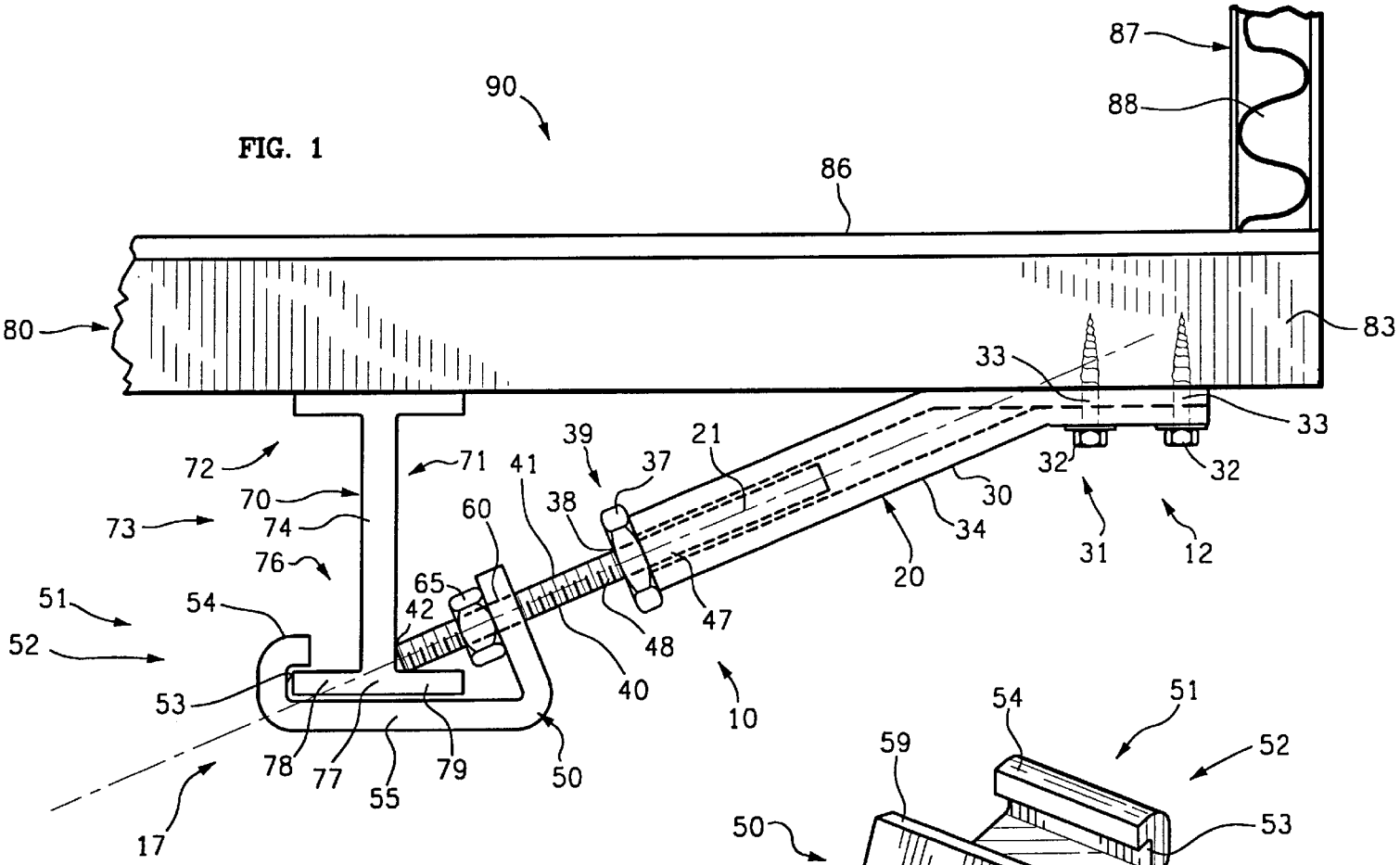
FIG. 1 is a partial front elevation view of a preferred embodiment of the outrigger of the invention in use on a manufactured hoe.

With reference now to drawings, FIG. 1 shows a preferred embodiment of the push/pull outrigger 10 of the invention in use on a typical manufactured home 90. The term manufactured home 90 includes mobile homes and trailer coaches. The structural elements typically include a plurality, typically a pair, of large main beams, such as I-beam 70, running the length of home 90, supporting a plurality of floor joists, typically transverse joists, such as joist 80, supporting a plurality of wall studs, such as stud 88. Although, an I-beam 70 is shown, the beam may have another construction, such as being a channel or C-beam, to which outrigger 10 may be readily adapted.

Each I-beam 70 is typically supported at a plurality of locations along its length by support piers (not shown). The support piers are typically supported by the ground or a foundation and may be of adjustable height.

I-beam upper end 72 supports floor joist 80 at a distance from joist outer end 83. I-beam 70 has an outer side 71 facing toward outer end 83 of floor joist 80, an opposite inner side 73 facing away, a vertical web 74 and a lower end 76. Lower end 76 includes a horizontal flange 77 which comprises an inner side flange 78 and an outer side flange 79.

Floor joist 80 supports everything above it including floor 86 and walls, including outer wall 87. Outer end 83 of joist 80 supports outer wall 87 of home 90 including wall studs 88.

Outrigger 10 includes an elongate portion 20 spanning between lower end 76 of beam 70 and outer end 83 of joist 80. Elongate portion 20 has a longitudinal axis 21 and generally comprises a fixed portion 30 and a movable portion 40. Outrigger 10 essentially spans between an upper end 12 connected to outer end 83 of joist 80 and a lower end 17 connected to lower end 76 of beam 70 such that outrigger 10 can selectively exert force along longitudinal axis 21, hereinafter a "longitudinal force" on joist outer end 83. The longitudinal force may be push, i.e. an "outward" force resulting from elongate portion 20 being in compression, or may be a pull, i.e. an "inward" force resulting from elongate portion being in tension.

Fixed portion 30 includes an upper end 31 adapted for attachment to outer end 83 of joist 80 such that outrigger 10 can exert an inward or outward force along longitudinal axis 21 on joist 80. Attachment means, such as fasteners such as carriage bolts 32 disposed through bores 33 in upper end 31, attach upper end 31 to joist outer end 83.

Fixed portion 30 has a lower end 39 including upper length adjusting means, such as threaded bore 38. Fixed portion 30 is a strong, rigid member. The majority of its length may be a metal pipe 34 with upper end 31 simply being a flattened portion of pipe 34. Threaded bore 38 on lower end 39 may be integral with pipe 34 or may be in a large fixed nut 37 attached, such as by welding, to pipe 34.

Movable portion 40, such as threaded shaft 41, has a lower end 42 adapted to be supported by lower end 76 of main beam 70 such that outrigger 10 can exert an outward longitudinal force on beam 80. In use with I-beam 70, shown, lower end 42 is upwardly supported by outward flange 79 and outwardly supported by web 74. Preferably, lower end 42 is configured, such as by being circular or partially spherical, and supported such that its rotation about longitudinal axis 21 is not impeded. Threaded shaft 41 has an upper end 47 including lower length adjustment means, such as externally threaded portion 48, cooperating with upper length adjustment means, bore 38, for adjusting the length of elongate portion 20 such that elongate portion 20 may exert an outward longitudinal force. Upper end threaded portion 48 is threaded in bore 38 with adjusting length stored inside pipe 34.

Figure 2:
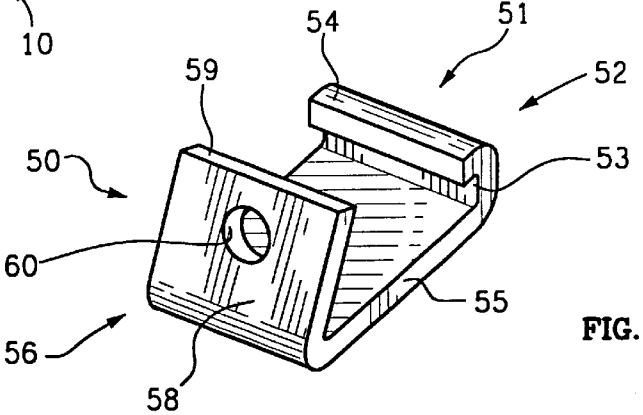
FIG. 2 is an enlarged perspective view of a preferred embodiment of the attachment bracket of the outrigger of FIG. 1.

With further reference also to FIG. 2, there is shown an enlarged perspective view of a preferred embodiment of the attachment bracket 50 of outrigger 10 of FIG. 1. Bracket 50 may be made of thick, strong metal, such as steel. Bracket 50 is adapted for attachment to shaft 41 and to lower end 76 of beam 70 such that bracket 50 can exert an inward longitudinal force on beam 70. Bracket 50 includes an inner end 51 and an outer end 56 joined by cross piece 55. Inner end 51 includes a holding portion 52 including a bearing surface 53 for bearing against inner side 73 of beam 70, such as against inner side of inner side horizontal flange 78. For use with an I-beam 70, holding portion 52 preferably includes an attachment flange 54 for slightly hooking over inner side flange 78 for bearing on its top surface for holding inner end 51 on beam 70. For a C-beam, bearing surface 53 would simply bear against the inside of web 74. Cross piece 55 crosses under beam 70. Outer end 56 includes an upward flange 58 having a lower end connected to cross piece 55 and an upper end 59. Upward flange 58 includes a through bore 60. Threaded shaft 41 freely passes through bore 60. Preferably, bracket 50 is made of a single piece of metal and is dimensioned such that it can be attached in situ to beam 70.

Cooperating means, such as nut 65, cooperates between bracket 50 and elongate portion 20 for selectively applying a inward longitudinal force on joist outer end 83. Nut 65 is attached to threaded shaft 41 between upward flange 58 and beam 70.

In use, the length of elongate portion 20 is adjusted by turning threaded shaft 41 in bore 38. Threaded shaft 41 is turned by any suitable means, such as by gripping it with a pipe wrench, channel lock or vice grips. Elongate portion 20 is attached to joist 80 by bolts 32 such that longitudinal axis 21 lies under joist and intersects the intersection of outer flange 79 and web 74. Upper end 48 of threaded shaft 40 is screwed inside of pipe 34 to allow space for attachment of bracket 50 to beam 70. Bracket 50 is attached to beam 70 by hooking attachment flange 54 over beam inner flange 78, then swinging outer end 56 up and unscrewing threaded shaft 41 so that it passes through bore 60. Then, nut 65 is attached to inner end 42 of shaft 41.

To exert an outward force on joist outer end 83, shaft 41 is unscrewed from bore 38 such that inner end 42 presses against beam 70. To exert an inward force on joist outer end 83, nut 65 is loosened and shaft 41 is screwed a way into bore 38. Then, shaft 41 is prevented from turning relative to nut 65, such as by being held, and nut 65 is screwed up shaft 41 to bear against upward flange 58. Nut 65 is further turned, i.e. tightened, to tension elongate portion 20 and exert an inward force on joist outer end 83.

Having described the invention, it can be seen that push/pull outrigger 10 provides a very desirable device for raising\lowering joist outer end 83 and thereby adjusting the level of the periphery of a manufactured home 90.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A push/pull outrigger for a manufactured home having a main beam having an upper end and a lower end; the upper end of the main beam supporting a transverse floor joist having an outer end that is distal from the beam; said outrigger comprising:

an elongate portion for spanning between the lower end of the beam and the outer end of the joist; said elongate portion having a longitudinal axis and comprising:

a fixed portion including:

an upper end adapted for attachment to the outer end of the joist such that said outrigger can exert an inward or outward longitudinal force on the joist;

upper length adjusting means; and a lower end; and a movable portion including:

a lower end adapted to be supported by the lower end of the beam such that said outrigger can exert an inward longitudinal force on the beam; said lower end including:

a threaded shaft;

an upper end; and lower length adjustment means cooperating with said upper length adjustment means for adjusting the length of said elongate portion such that said elongate portion may exert an outward longitudinal force on the outer end of the joist;

a bracket adapted for attachment to the lower end of the beam such that said bracket can exert an outward longitudinal force on the beam; said bracket including a bore through which said threaded shaft of said lower end of said movable portion is freely disposed; and cooperating means cooperating between said bracket and said elongate portion for selectively applying an inward longitudinal force on the joist; said cooperating means including:

a threaded nut attached to said threaded shaft of said lower end of said movable portion between said bracket and said beam.

2. The outrigger of claim 1 wherein:

said upper length adjustment means and said lower length adjustment means includes cooperating screw threads.

3. The outrigger of claim 1 wherein:

said upper length adjustment means includes an internally threaded bore; and said lower length adjustment means includes an externally threaded shaft.

4. The outrigger of claim 1 wherein:

said bracket includes a bore; and said lower end of said movable portion is freely disposed through said bore.

5. A push/pull outrigger for a manufactured home having a main beam and a transverse floor joist; the main beam having an upper end supporting a transverse floor joist having an outer end that is distal from the beam; the main beam having: an outer side toward the outer end of the floor joist; an inner side; and a lower end including an outer side horizontal flange and an inner side horizontal flange having an inner side; said outrigger comprising:

an elongate portion for spanning between the lower end of the beam and the outer end of the joist; said elongate portion having a longitudinal axis and comprising:

a fixed portion including:

an upper end adapted for attachment to the outer end of the joist such that said outrigger can exert an inward or outward longitudinal force on the joist;

upper length adjusting means; and a lower end; and a movable portion including:

a lower end adapted to be supported by the outer side flange on the lower end of the beam such that said outrigger can exert an inward longitudinal force on the beam;

an upper end; and lower length adjustment means cooperating with said upper length adjustment means for adjusting the length of said elongate portion such that said elongate portion may exert an outward longitudinal force on the outer end of the joist;

a bracket adapted for attachment to said movable portion and to the lower end of the beam such that said bracket can exert an outward longitudinal force on the beam; said bracket including:

a holding portion for bearing against said inner side of said inner side flange and cooperating means cooperating between said bracket and said elongate portion for selectively applying an inward longitudinal force on the joist.

6. The outrigger of claim 5 wherein:

said upper length adjustment means and said lower length adjustment means includes cooperating screw threads.

7. The outrigger of claim 5 wherein:

said upper length adjustment means includes an internally threaded bore; and said lower length adjustment means includes an externally threaded shaft.

8. The outrigger of claim 5 wherein:

said bracket includes a bore; and said lower end of said movable portion is freely disposed through said bore.

9. The outrigger of claim 5 wherein:

said bracket includes a bore;

said lower end of said movable portion includes a threaded shaft freely disposed through said bore; and said cooperating means includes a threaded nut attached to said threaded shaft of said lower end of said movable portion between said bracket and said beam.

10. A manufactured home including:

a main beam including;

an upper end;

an outer side;

an inner side opposite said outer side;

a lower end;

a transverse floor joist supported by said upper end of said main beam and having an outer end that is distal from said beam; said main beam outer side facing toward said outer end of said floor joist; and an outrigger comprising:

an elongate portion spanning between said lower end of said beam and said outer end of said joist; said elongate portion having a longitudinal axis and comprising:

a fixed portion including:

an upper end adapted for attachment to said outer end of said joist such that said outrigger can exert an inward or outward longitudinal force on said joist;

upper length adjusting means; and a lower end; and a movable portion including:

a lower end adapted to be supported by said lower end of said main beam such that said outrigger can exert an inward longitudinal force on said beam;

an upper end; and lower length adjustment means cooperating with said upper length adjustment means for adjusting the length of said elongate portion such that said elongate portion may exert an outward longitudinal force on said outer end of said joist;

a bracket adapted for attachment to said movable portion and to said lower end of said beam such that said bracket can exert an outward longitudinal force on said beam; and cooperating means cooperating between said bracket and said elongate portion for selectively applying a inward longitudinal force on said joist.

11. The manufactured home of claim 10 wherein:

said upper length adjustment means and said lower length adjustment means includes cooperating screw threads.

12. The manufactured home of claim 10 wherein:

said upper length adjustment means includes an internally threaded bore; and said lower length adjustment means includes an externally threaded shaft.

13. The manufactured home of claim 10 wherein:

said bracket includes a bore; and said lower end of said movable portion is freely disposed through said bore.

14. The manufactured home of claim 10 wherein:

said bracket includes a bore;

said lower end of said movable portion includes a threaded shaft freely disposed through said bore; and said cooperating means includes a threaded nut attached to said threaded shaft of said lower end of said movable portion between said bracket and said beam.

15. The manufactured home of claim 10 wherein:

said lower end of said main beam further includes:

an inner side horizontal flange including:

an inner side; and wherein:

said bracket includes:

a bearing surface for bearing against said inner side of said inner side horizontal flange.

16. The manufactured home of claim 10 wherein:

said lower end of said main beam further includes:

an inner side flange; and wherein:

said bracket includes:

a hook portion for hooking over said inner side flange.

17. The manufactured home of claim 10 wherein:

said lower end of said main beam further includes:

an outer side flange; and wherein:

said lower end of said outrigger elongate portion is adapted to be supported by said outer side flange.

18. The manufactured home of claim 10 wherein:

said lower end of said main beam further includes:

an outer side flange; and an inner side flange; and wherein:

said bracket includes:

a hook portion for hooking over said inner side flange; and wherein:

said lower end of said outrigger elongate portion is adapted to be supported by said outer side flange.

19. A push/pull outrigger for a manufactured home having a main beam and a transverse floor joist; the main beam having an upper end supporting a transverse floor joist having an outer end that is distal from the beam; the main beam having: an outer side toward the outer end of the floor joist; an inner side; and a lower end including an outer side horizontal flange; said outrigger comprising:

an elongate portion for spanning between the lower end of the beam and the outer end of the joist; said elongate portion having a longitudinal axis and comprising:

a fixed portion including:

an upper end adapted for attachment to the outer end of the joist such that said outrigger can exert an inward or outward longitudinal force on the joist;

upper length adjusting means; and a lower end; and a movable portion including:

a lower end adapted to be supported by the inner side flange on the lower end of the beam such that said outrigger can exert an inward longitudinal force on the beam; said lower end including a threaded shaft;

an upper end; and lower length adjustment means cooperating with said upper length adjustment means for adjusting the length of said elongate portion such that said elongate portion may exert an outward longitudinal force on the outer end of the joist;

a bracket adapted for attachment to said movable portion and to the lower end of the beam such that said bracket can exert an outward longitudinal force on the beam; said bracket including a bore through which said threaded shaft of said lower end of said movable portion is freely disposed; and cooperating means cooperating between said bracket and said elongate portion for selectively applying an inward longitudinal force on the joist includes:

a threaded nut attached to said threaded shaft bracket and said lower end of said movable portion between said bracket and said beam.

20. A push/pull outrigger for manufactured home having a main beam and a transverse floor joist; the main beam an upper end supporting a transverse floor joist having an outer end that is distal from the beam; the main beam having: an outer side toward the outer end of the floor joist; an inner side; and a lower end including an inner side horizontal flange and an outer side flange; said outrigger comprising:

an elongate portion for spanning between the lower end of the beam and the outer end of the joist; said elongate portion having a longitudinal axis and comprising:

a fixed portion including:

an upper end adapted for attachment to the outer end of the joist such that said outrigger can exert an inward or outward longitudinal force on the joist;

upper length adjusting means; and a lower end; and a movable portion including:

a lower end adapted to be supported by the flange on the lower end of the beam such that said outrigger can exert an inward longitudinal force on the beam;

an upper end; and lower length adjustment means cooperating with said upper length adjustment means for adjusting the length of said elongate portion such that said elongate portion may exert an outward longitudinal force on the outer end of the joist;

a bracket adapted for attachment to said movable portion and to the lower end of the beam such that said bracket can exert an outward longitudinal force on the beam; said bracket including:

a hook portion for hooking over said inner side flange; and cooperating means cooperating between said bracket and said elongate portion for selectively applying an inward longitudinal force on the joist.

* * * * *